US007476793B2

(12) United States Patent
Williams et al.

(10) Patent No.: US 7,476,793 B2
(45) Date of Patent: Jan. 13, 2009

(54) FOSTER EXTENSION FOR FLUTES

(76) Inventors: Gail I. Williams, 16 Charlemont Rd., Medford, MA (US) 02155; David C. Williams, 16 Charlemont Rd., Medford, MA (US) 02155

( * ) Notice: Subject to any disclaimer, the term of this patent is extended or adjusted under 35 U.S.C. 154(b) by 41 days.

(21) Appl. No.: 11/804,983

(22) Filed: May 22, 2007

(65) Prior Publication Data

US 2008/0289475 A1 Nov. 27, 2008

(51) Int. Cl.
*G10D 7/02* (2006.01)

(52) U.S. Cl. ..... 84/384

(58) Field of Classification Search ..... 84/384
See application file for complete search history.

(56) References Cited

U.S. PATENT DOCUMENTS

| | | | | | |
|---|---|---|---|---|---|
| 17,054 | A * | 4/1857 | Pfaaf | 84/384 |
| 444,830 | A * | 1/1891 | Guenther | 84/384 |
| 4,213,371 | A * | 7/1980 | Thayer | 84/390 |
| 4,649,790 | A * | 3/1987 | Weeks | 84/384 |
| 4,962,007 | A * | 10/1990 | Phelan | 428/670 |
| 6,060,654 | A * | 5/2000 | Valtchev et al. | 84/453 |
| 6,124,538 | A * | 9/2000 | Landell | 84/384 |
| 6,259,010 | B1 * | 7/2001 | Nagahara | 84/380 R |
| 6,297,436 | B1 * | 10/2001 | Adams | 84/388 |
| 6,660,919 | B2 * | 12/2003 | Lim | 84/384 |
| 7,112,734 | B2 * | 9/2006 | Richter | 84/384 |
| 2007/0272071 | A1 * | 11/2007 | Parmenon | 84/384 |

* cited by examiner

*Primary Examiner*—Walter Benson
*Assistant Examiner*—Robert W Horn
(74) *Attorney, Agent, or Firm*—Lambert and Associates; Gary E. Lambert

(57) ABSTRACT

A flute attachment which improves and enhances the harmonic capability of a flute by lengthening the resonant chamber of the standing wave. The instant invention 'fine tunes' the harmonic range of the flute by taking into account the end point of the fundamental length of the sounding oscillations of an air column without negating the frequency which has been predetermined by the original terminus of the physical scale length of the flute. The sound wave length within a flute terminates slightly beyond the physical length of the flute tube and this difference in length is known as the 'end correction'. The instant invention captures the node which extends beyond the flute tubing and balances and reinforces the propagation of upper partials throughout the sounding range of the instrument.

17 Claims, 5 Drawing Sheets

FOSTER EXTENSION FOR FLUTES

BACKGROUND OF THE INVENTION

1. Field of Invention

The invention relates generally to the field of musical instrument improvements and accessories and specifically to flutes.

2. Description of the Related Art

The scale system of the modern Boehm flute has been designed with a focus on accuracy of pitch production as defined through 1) the placement of the tone holes; 2) the size of the tone holes; and 3) the interior diameter and length of tubing upon which the tone holes are placed. These factors are combined in a mathematical schema to arrive at the best compromise of pitch and intonation for each flute.

The harmonic content of the individual notes may vary widely depending on the variations in schema and the manipulation of different factors in the schema. It is widely accepted that an increase to the overall length of the tubing (or scale length) has the effect of increasing the complexity of the harmonic content of all notes played on the flute while enhancing its resonance and projective capability.

Scale length is defined as the length of the sounding wave from the cork plate of the headjoint to the cutoff end of the footjoint on any flute. This increase in scale length may be accomplished with the addition of a short length of tubing applied to the bottom end of the footjoint of any existing flute.

However, when applied to an existing instrument, the scale length addition also has the adverse effect of creating irresolvable intonation problems in the bottom three notes of the scale and an overall degradation of the relationship between the scale tones throughout the sounding range of the flute. This occurs because the mathematical relationship (schema) between the bore (inner dimension), the length of the tube (scale length) and the placement (and size) of the tone holes becomes invalidated by changing one factor without adjusting the others to compensate for that change.

The subject invention focuses upon increasing the harmonic content of the instrument throughout its full range and increasing the projective capacity of the flute by increasing the length of any existing flute without any of the adverse effects discussed above.

The subject invention accomplishes this task by adding a carefully defined and proportioned length of tubing to the bottom of the flute tube (footjoint). This length of tubing is designed with a venting system specifically placed to eliminate the adverse effects normally encountered by increasing the length of an existing scale.

BRIEF SUMMARY OF THE INVENTION

The subject invention encompasses an attachment for a flute comprising an attachable length of tubing; wherein said length of tubing further comprises a first end to be inserted into the footjoint of said flute, wherein the diameter of said first end of said length of tubing is reduced by 0.025 inches from the diameter of said flute footjoint to which said first end of said length of tubing is to be inserted; further wherein said length of tubing further comprises a protruding end not to be inserted in said flute footjoint; wherein said protruding end comprises a major bore diameter that is equal to or slightly exceeds the diameter of said flute; further wherein said protruding end comprises a first and second vent; and wherein said protruding end comprises a length which contains a final air pressure node produced by playing said flute.

These together with other objects of the invention, along with the various features of novelty which characterize the invention, are pointed out with particularity in the claims annexed to and forming a part of this disclosure. The invention is not limited to the embodiments described herein; thus, reference should be made to the accompanying drawings and descriptive matter in which the preferred embodiments of the invention are illustrated.

DETAILED DESCRIPTION OF THE INVENTION

Figure 1:
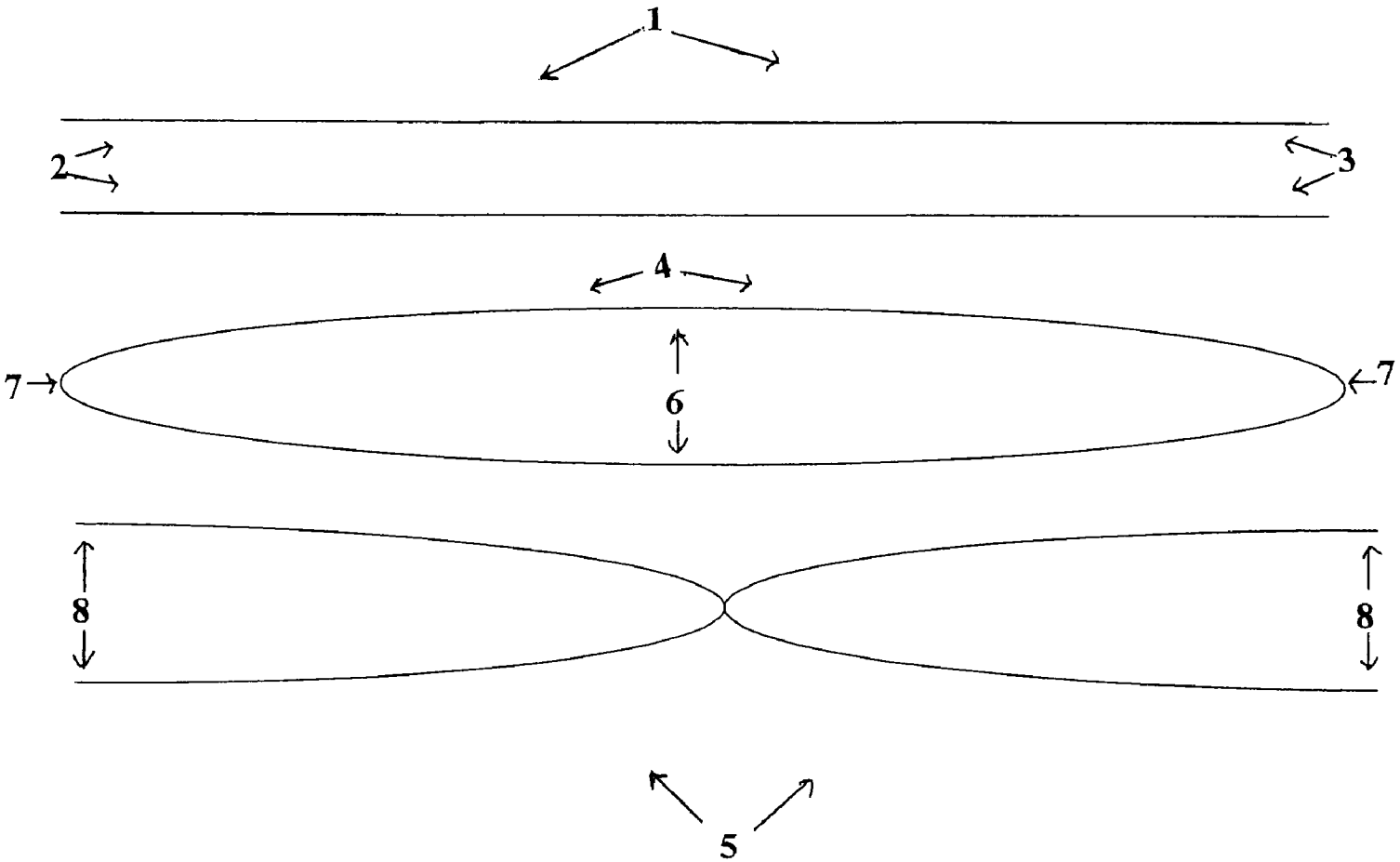
FIG. 1 illustrates a representation of a cross-sectional view of flute tubing with an opening on both ends; and further illustrates a representation of the variation in air pressure within flute tubing and a representation of the displacement of the air molecules within flute tubing.

In order to play the flute, a player blows a rapid jet of air across the embouchure hole. The player accelerates this jet of air by continuously providing power to this jet of air. The power provided by the player to the jet of air is analogous to direct current (DC) electrical power.

However, the sound produced by the flute from this continuous jet of air requires an oscillating motion of air flow analogous to alternating current (AC) electrical power. In the flute, the jet of air, in cooperation with the resonances in the air within the flute, produces an oscillating component of the air flow. Once the air within the flute is vibrating, some of the energy is radiated as sound out of the end and any open holes of the flute. A much greater amount of energy is lost as a sort of friction with the internal wall of the flute. In a sustained note, this energy is replaced by energy input by the player. The column of air in the flute vibrates much more easily at some frequencies than at others (i.e. it resonates at certain frequencies). These resonances largely determine the playing frequency and thus the pitch, and the player in effect chooses the desired set of resonances by choosing a suitable combination of keys.

The jet of air from the player's lips travels across the embouchure-hole opening and strikes against the sharp further edge of the embouchure hole. If such a jet of air is disturbed, then a wave-like displacement travels along it and deflects it so that it may flow either into or out of the embouchure hole. The speed of this wave-like displacement on the jet of air is about half the speed of the jet of air (which is typically in the range 20 to 60 meters per second, depending on the air pressure in the player's mouth). The origin of the disturbance of the jet of air is the sound vibration in the flute tube, which causes air to flow into and out of the embouchure hole. If the jet of air speed is carefully matched to the frequency of the note being played, then the jet of air will flow into and out of the embouchure hole at its further edge in just the right phase to reinforce the sound and cause the flute to produce a sustained note.

A flute is open at both ends. As noted above, although player's lower lip covers part of the embouchure hole, she or he leaves a large part of the hole opening to the atmosphere. In addition, the flute contains an opening at the far end, away from the player. Since a flute is open to the air at both ends, the total pressure at these ends must be atmospheric pressure. In other words, the acoustic pressure, (the variation in pressure within the flute due to sound waves) must be zero. The flute contains specific points called pressure nodes which effectively lie past the end of the flute tubing by a small distance (about 0.6 times the radius). This distance is called the end correction. Inside the flute tubing, the air pressure does not need to be atmospheric. Indeed, in the first resonance the maximum variation in pressure (the pressure anti-node) occurs at the middle.

The longest standing wave, or fundamental wave, that can satisfy the condition of zero pressure at either end of the flute is twice as long as the flute tubing. The frequency f equals the wave speed v divided by the wavelength λ, so this longest wave corresponds to the lowest note on the flute: C4 on a C foot instrument.

Figure 2:
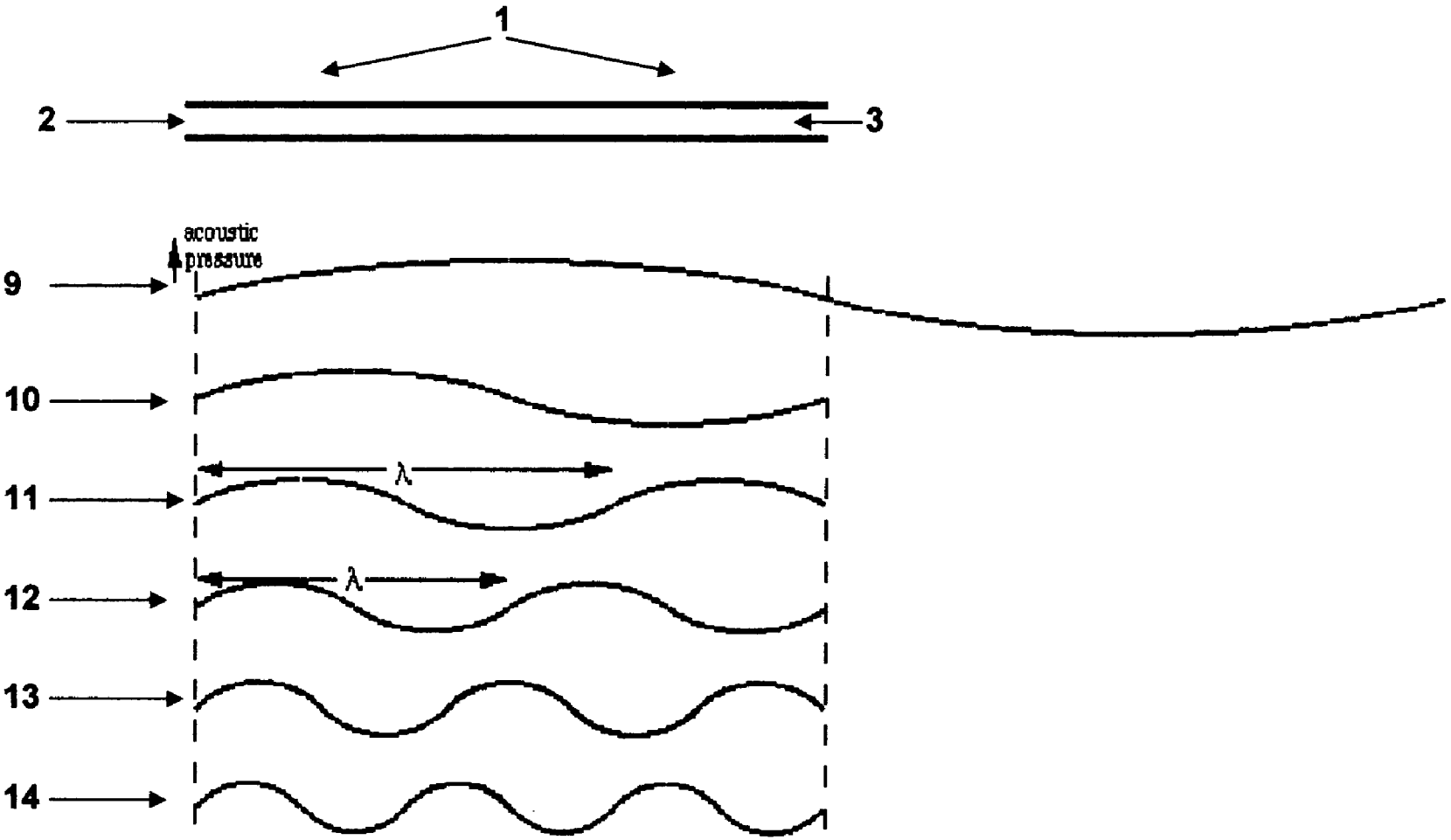
FIG. 2 illustrates the various wavelengths within flute tubing.

Using the simple calculations shown on FIG. 2 to calculate the frequency played by a flute is only approximately correct. The 'effective length' is the value of length that, when substituted into these approximate equations, gives the correct (i.e. measured) frequency. The difference between the 'effective length' and the real length of the flute is called the end correction.

What causes the end correction was first analyzed by John Strutt (a.k.a. Lord Rayleigh). When the air in a flute tubing vibrates in a resonance, it does so along the axis, with maximum vibration at an open end. Just outside the open end is some air that must be pushed forward and backwards by the vibration of air inside the flute tubing. That air has mass and inertia, and its that inertia that lowers the pitch of the flute. Outside the flute tubing, the sound wave radiates in nearly all directions, so the further you go from the open end, the less the effect and only air very near to the open ends of the flute tubing is involved. This air outside the open ends of the flute tubing make the flute tubing effectively longer than it really is. For a simple open pipe, the extra length is about 0.6 times its radius.

End corrections are more complicated in real instruments. The end correction at the foot of a flute for the lowest note of the instrument is indeed about 0.6 times its radius. For the flute, the tubing is open at both ends, but a player can vary the embouchure hole opening by rolling it towards themselves (which makes a longer end effect—the note goes flat) or away (conversely). There is also the small volume of air between the embouchure hole and the cork. Finally, if we consider a woodwind instrument with several open tone holes, it is not just the air outside the first tone hole that must be vibrated, but air inside the bore, too. So the end correction is longer here.

What is missing from the design of the flute is a mechanism that captures and focuses this aspect of wave formation. The tradition of flute making has involved an empirical derivation of tubing length and tone hole placement which has been passed through the generations of craftsmen. The focus of this empirical work has always been to define a length of tubing that would most accurately produce a given pitch.

This invention of the subject application goes a step beyond these computations to create an in-depth, comprehensive method of strengthening the projective and resonant capabilities of the instrument without tampering with the pitch.

As shown in FIG. 1, straight lines represent a cross-sectional view of flute tubing 1 with openings 2 and 3 on either end of the flute. A player blows a jet of air across the embouchure hole into this flute tubing 1. The lines 4 represent the variation in air pressure within the flute tubing 1 along the same length of flute tubing 1. Pressure anti-node 6 of lines 4 indicates the maximum variation in pressure in this resonance. Pressure node 7 indicates the minimum variation in pressure in this resonance. The lines 5 represent the variation in the displacement of the air molecules within the flute tubing 1 along the same length of flute tubing 1. The lines 5 has displacement anti-node 8 at the ends since air molecules are free to move in and out at the open ends of the flute tubing 1.

As noted above, flute tubing 1 is open at both ends, openings 2 and 3. Although a player's lower lip covers part of the embouchure hole, she or he leaves a large part of the hole open to the atmosphere. Since a flute is open to the air at both ends, the total pressure at these ends must be atmospheric pressure or the acoustic pressure, (the variation in pressure within the flute due to sound waves) must be zero.

FIG. 2 illustrates the longest standing wave, or fundamental wave 9, that can satisfy the condition of zero pressure at either end of the flute tubing 1. FIG. 1 illustrates one half of the fundamental wave 9 with lines 4. Thus, FIG. 2 shows that this fundamental wave 9 has a wavelength that is twice as long as flute tubing 1. The frequency f equals the wave speed v divided by the wavelength λ, so this longest wave corresponds to the lowest note on the flute: C4 on a C foot instrument The equations for determining frequency are:

$$=2L$$

$$f=v/\lambda=v/2L=f_0$$

Wherein λ=wavelength; f=frequency; v=wave speed; L=length of flute tubing; and $f_0$=fundamental frequency.

FIG. 2 illustrates the wavelength λ for the fundamental frequency 9; the wavelength λ for the second harmonic 10; the wavelength λ for the third harmonic 11; the wavelength λ for the fourth harmonic 12; the wavelength λ for the fifth harmonic 13; and the wavelength λ for the sixth harmonic 14.

The above calculations are only approximately correct in calculating the frequency played by a flute. The 'effective length' is the value of length that, when substituted into these approximate equations, gives the correct (i.e. measured) frequency. The difference between the 'effective length' and the real length of the flute is called the end correction.

For example, if a pipe that is 170 millimeters long and sealed at one end is played until the pipe resonates or produces its own strong vibration. To calculate the frequency of this vibration, (supposing that temperature and humidity are such that the speed of sound is 340 meters/second) the lowest resonance should have a wavelength about 4 times longer than the closed pipe since the pipe is closed at one end like a clarinet. If the pipe had been open at both ends, like a flute, that the lowest resonance should have a wavelength that is twice the length of the open pipe. Now 4 multiplied by 170 millimeters is a wavelength of 680 millimeters or 0.68 meters. Thus, according to this sample calculation, the frequency of this lowest resonance, which is speed of sound divided by wavelength, should be approximately 340 meters/second divided by 0.68 meters=500 Hertz. Similarly, if this pipe had been open at both ends the wavelength would be 2 multiplied by 170 millimeters to equal 0.34 meters with a calculated frequency of 1000 Hz.

However, the measured frequency is slightly lower than what is calculated, and the larger the diameter of the pipe, the larger the depression of the pitch. The pipe produces a wavelength as though it were a little longer than it really is. Now the effective length is the length that would give me exactly the measured frequency. Thus, as we said above, the effective length minus the real length is called the end correction. For the open pipe, there will be two end corrections, one for each open end. The end correction at the foot of a flute for the lowest note of the instrument is indeed about 0.6 times its radius.

This invention compensates for the absence of balance in tone production by creating a chamber for the bottom end of the wave from which closely resembles the top end. The result is a more balanced wave from which captures energy which would normally be lost through atmospheric dissipation (as it extends beyond the end of the normal flute tube). This invention provides the player with a device with which to manipulate the timbre and dynamic range of the modern flute in an entirely heretofore unseen degree.

Figure 3:
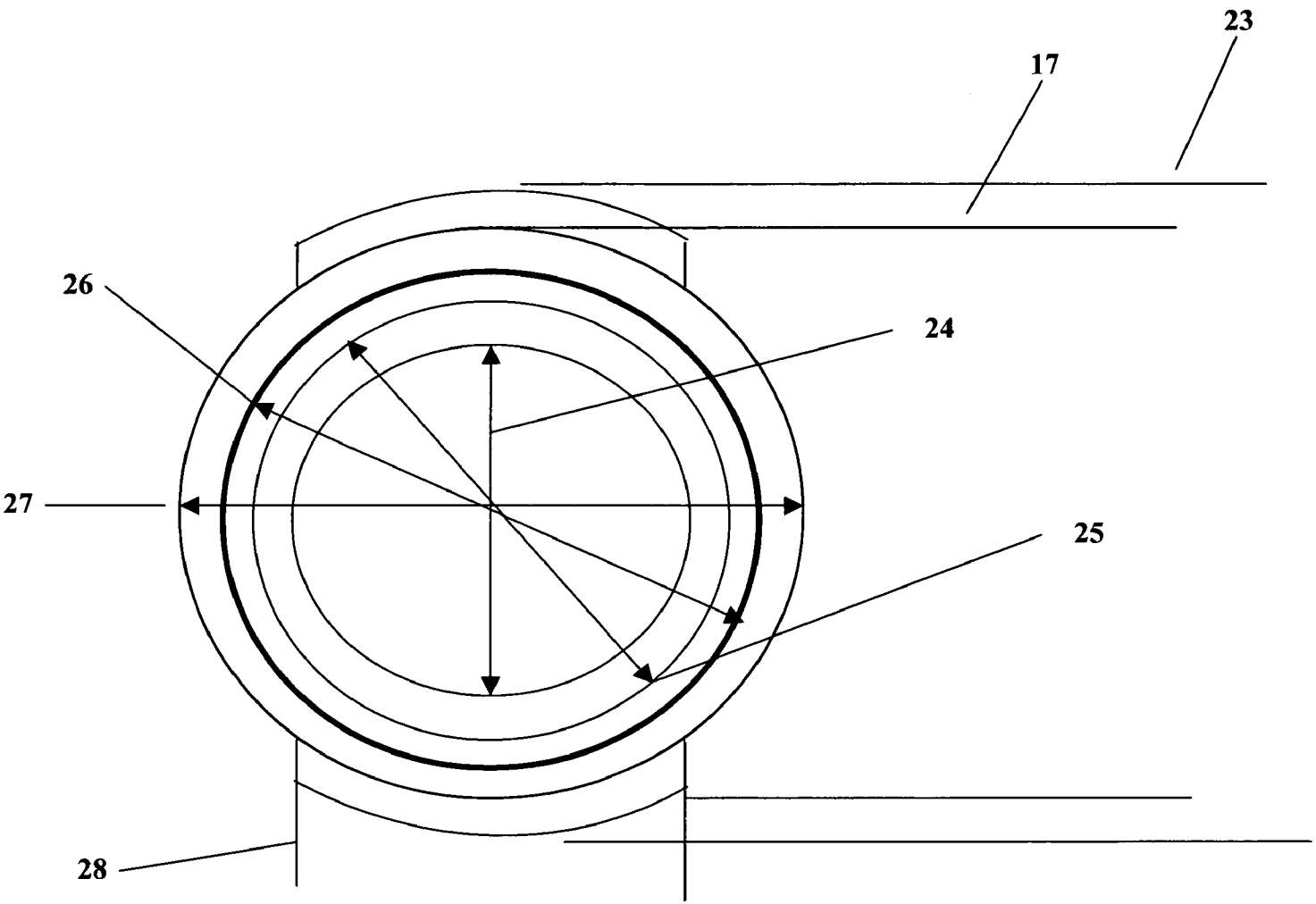
FIG. 3 illustrates an end view of the Foster extension.

FIG. 3 illustrates an end view of the Foster Extension. The larger diameter tubing and the smaller (tenon) tubing which is inserted in the flute footjoint are shown. FIG. 3 also illustrates the unique vent hole configuration 17 which has a surface concentric to the radius of the major outer diameter of the 0.81 inch diameter tubing surface 23. Further the 0.5 inch end of said length of tubing comprises an internal diameter 24 of 0.72 inches and an external diameter 25 of 0.74 inches. The said first end of said length of tubing comprises a length of 0.5 inches. The non-inserted protruding 2 inch second end of said length of tubing comprises an internal diameter 26 of 0.747 inches and an external diameter 27 of 0.775 inches. The non-inserted protruding second end of said length of tubing may comprise a length of 2 inches and the first vent hole and said second vent hole 28 comprise an internal diameter of 0.69 inches.

Figure 4:
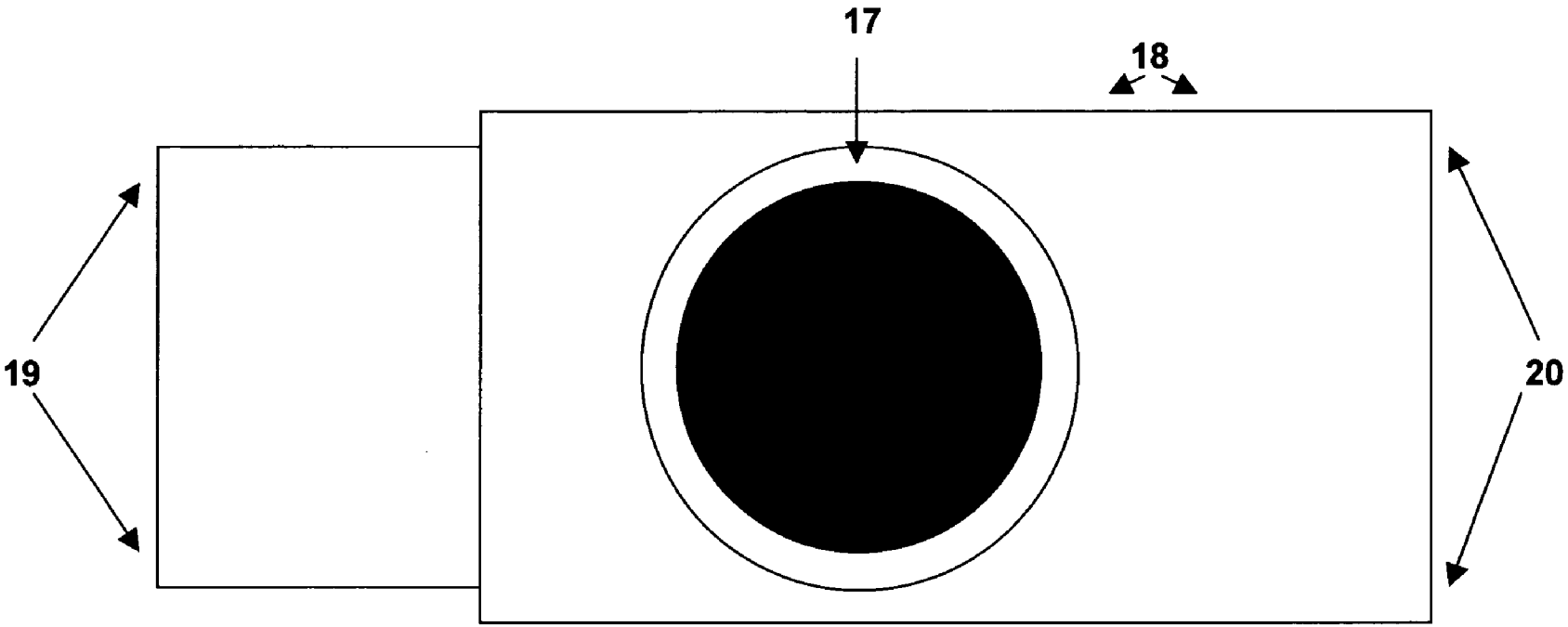
FIG. 4 illustrates a top view of the Foster extension.

FIG. 4 illustrates the top view of the Foster Extension. The vent hole 17 shown represents one of two which are constructed directly opposite each other on the outside circumference of the tubing 18. This design requires two different diameters of tubing contiguous to a single length. The smaller diameter length 19 is intended to be inserted into the footjoint end of the flute and is required only as a mechanism to keep the attachment in place. There are two vent openings 17 which are tangent to the end of the tubing and are intended to allow the end of the existing flute tube to define the length of the wave form without dampening or flattening the pitch. The remaining tubing 20 serves to capture the node of the wave which would normally fall outside the end of the flute tubing (end correction).

Figure 5:
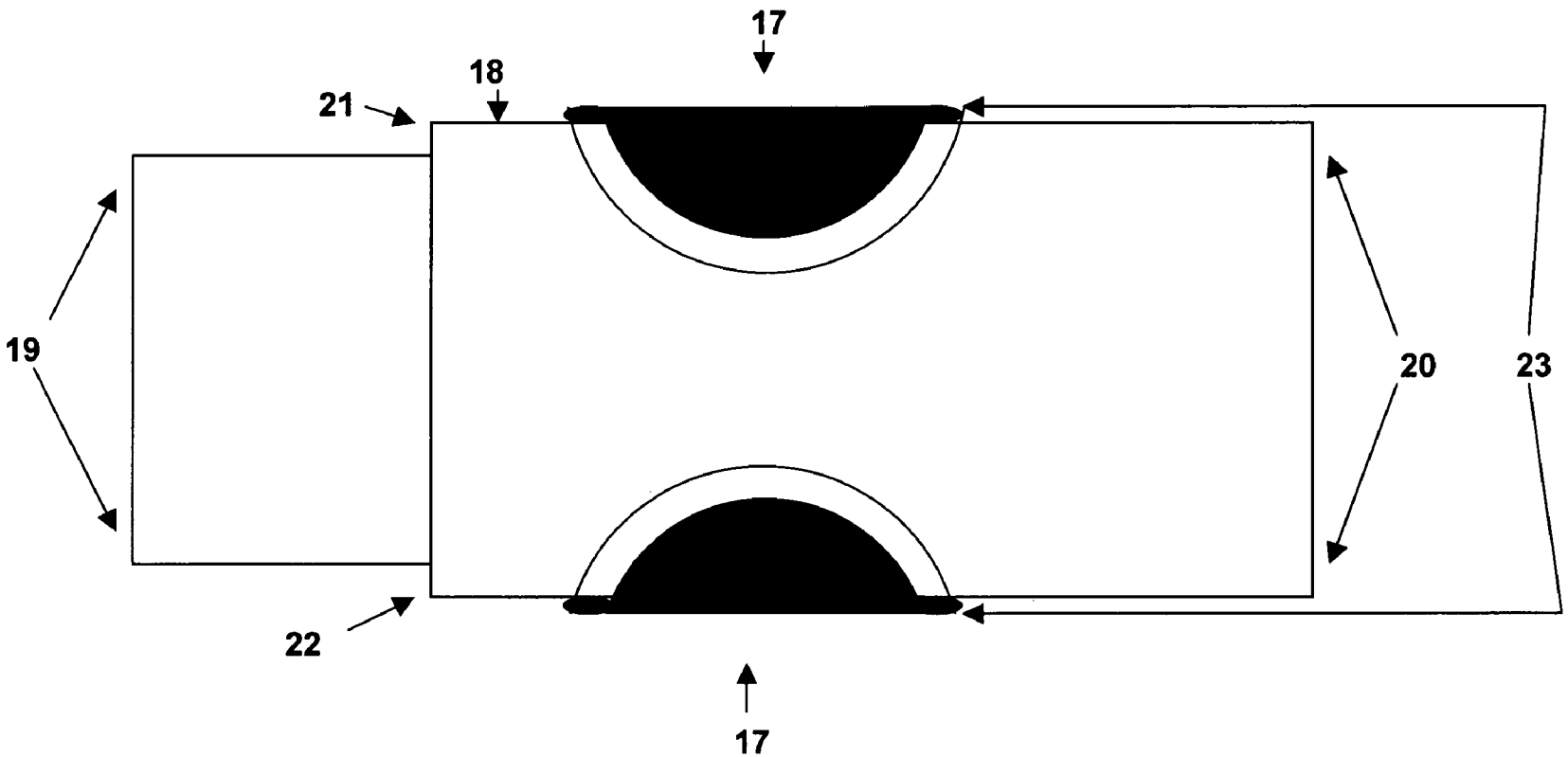
FIG. 5 illustrates a side view of the Foster extension.

FIG. 5 illustrates the side view of the Foster Extension. The two vent holes 17 shown on the top 21 and the bottom 22 of the Foster extension are constructed directly opposite each other on the outside circumference of the tubing 18. This design requires two different diameters of tubing contiguous to a single length. The smaller diameter length 19 is intended to be inserted into the footjoint end of the flute and is required only as a mechanism to keep the attachment in place. There are two vent openings 17 which are tangent to the end of the tubing and are intended to allow the end of the existing flute tube to define the length of the wave form without dampening or flattening the pitch. The remaining tubing 20 serves to capture the node of the wave which would normally fall outside the end of the flute tubing (end correction). Further, the diameter measurement 23 between the two vent openings 17 will be 0.81 inch.

In one embodiment of the subject invention, the foster extension is manufactured from a piece of metal tubing having the overall length of 3 inches and an inside diameter of 0.747 inches. This piece of metal tubing is mounted upon a reducing mandrel. Approximately 0.75 inches of the length of this metal tubing is spun down in a lathe fixture until it has been reduced to by approximately 0.25 inches in length. This forms the tenon, or connecting piece, which will be inserted into the bottom of the footjoint section of the flute.

Two toneholes are located on opposite sides of the remaining part of the tubing with the outside surface of their radius flush with the point at which the reduced section of the tubing begins. This functions as a venting schema which allows the air column to effectively "see" the original cutoff point as the end of the tube (in terms of pitch).

The extension of the subject invention may be constructed from any material capable of retaining the required dimensions without distortion, including, but not limited to: precious metal of any alloy, wood, ceramic, glass and crystal. The extension of the instant invention is intended for use on flutes constructed of any material, including, but not limited to: precious metal of any alloy, wood, ceramic, glass and crystal.

The subject invention is designed and constructed to be a portable and removable attachment to be used with any existing flute which will improve both the harmonic content (timbrel complexity) and the projective capability of any scale design.

The instant invention may be applied to any pitched flute of any dimensions and encompasses the full range of flute sizes and any variation in pitch or scale design including, but not restricted to: C flute, G (alto) flute and C Bass flute. It is also designed to work on piccolos of any pitch or construction.

The instant invention further illustrates a method of strengthening the projective and resonant capabilities of an instrument, without altering the pitch. This method comprises reducing the diameter of a first end of a length of tubing by 0.025 inches from the diameter of a flute footjoint to which said first end of said length of tubing is to be inserted, inserting said first end of said length of tubing length into said flute footjoint, attaching said length of tubing to said flute footjoint, supplying said length of tubing with a non-inserted protruding second end wherein said non-inserted protruding second end comprises a major bore diameter that is equal to or slightly exceeds the diameter of said flute, supplying said non-inserted protruding second end with a first and second vent, and supplying said non-inserted protruding second end with a length which contains a final air pressure node.

We claim:

1. An attachment for a flute comprising:

an attachable length of tubing; wherein said length of tubing further comprises a first end to be inserted into a said flute footjoint, wherein a diameter of said first end of said length of tubing is reduced by 0.025 inches from the a diameter of said flute footjoint to which said first end of said length of tubing is to be inserted;

wherein said length of tubing further comprises a non-inserted protruding second end, opposite to said first end be inserted into said flute footjoint, wherein said non-inserted protruding second end comprises a major bore diameter substantially equal to said diameter of said flute;

wherein said second protruding end comprises a first and second vent which are tangent to the end of the tubing and are indented to allow the end of the existing flute tube to define the length of the waveform without dampening or flattening the pitch; and, wherein said second protruding end comprises a length comprises a final air pressure node produced by playing said flute.

2. The attachment for a flute of claim 1 said non-inserted protruding second end comprises a major bore diameter is slightly greater than said diameter of said flute.

3. The attachment for a flute of claim 1 wherein said flute may be selected from the group consisting of a C flute, a G flute and a C Bass flute.

4. The attachment for a flute of claim 1 wherein said flute may be constructed from a material selected from the group consisting of metal, wood, ceramic, glass and crystal.

5. The attachment for a flute of claim 1 wherein said attachment may be constructed from a material selected from the group consisting of metal, wood, ceramic, glass and crystal.

6. The attachment for a flute of claim 1 wherein said attachment may be constructed from a metal selected from the group consisting of gold, silver, platinum, nickel, tin and brass.

7. The attachment for a flute of claim 1 wherein said first end of said length of tubing comprises an internal diameter of 0.72 inches.

8. The attachment for a flute of claim 1 wherein said first end of said length of tubing comprises an external diameter of 0.747 inches.

9. The attachment for a flute of claim 1 wherein said first end of said length of tubing comprises a length of 0.5 inches.

10. The attachment for a flute of claim 1 wherein said non-inserted protruding second end of said length of tubing comprises an internal diameter of 0.74 inches.

11. The attachment for a flute of claim 1 wherein said non-inserted protruding second end of said length of tubing comprises an external diameter of 0.775 inches.

12. The attachment for a flute of claim 1 wherein said non-inserted protruding second end of said length of tubing comprises a length of 2 inches.

13. The attachment for a flute of claim 1, wherein said first vent comprises an internal diameter of 0.69 inches.

14. The attachment for a flute of claim 1, wherein said second vent comprises an internal diameter of 0.69 inches.

15. A method of manufacturing a flute attachment comprising the following steps:

a. obtaining a piece of metal tubing possessing an overall length of at least 3 inches and an internal diameter of 0.747 of an inch;

b. mounting said piece of metal tubing upon a reducing mandrel on a lathe apparatus;

c. reducing 0.75 of an inch of said overall length of said piece of metal tubing by 0.025.

d. trimming the spun down 0.75 of an inch of said overall length of said piece of metal tubing to 0.5 of an inch;

e. soldering a set of tone holes to an outer surface of said tubing that are tangential to the end of the tubing and are indented to allow the end of the existing flute tube to define the length of the waveform without dampening or flattening the pitch; and f. turning said piece of metal tubing in a lathe apparatus to create tone hole surfaces concentric to said tubing at a final diameter of 0.81 of an inch.

16. A method of strengthening the projective and resonant capabilities of an instrument without altering the pitch comprising:

a. reducing a diameter of a first end of a length of tubing by 0.025 inches from the diameter of a flute footjoint to which said first end of said length of tubing is to be inserted;

b. inserting said first end of said length of tubing length into said flute footjoint;

c. attaching said length of tubing to said flute footjoint;

d. supplying said length of tubing with a non-inserted protruding second end wherein said non-inserted protruding second end comprises a major bore diameter that is substantially equal to a diameter of said flute;

e. supplying said non-inserted protruding second end with a first and second vent which are tangent to the end of the tubing and are indented to allow the end of the existing flute tube to define the length of the waveform without dampening or flattening the pitch; and, f. supplying said non-inserted protruding second end with a length which contains a final air pressure node.

17. The method of strengthening the projective and resonant capabilities of an instrument without altering the pitch of claim 16 wherein said major bore diameter is slightly greater than said diameter of said flute.

* * * * *